US005848941A

United States Patent [19]

Morra

[11] Patent Number: 5,848,941

[45] Date of Patent: Dec. 15, 1998

[54] LIGHTED PRACTICE GOLF CLUB

[76] Inventor: Joseph Morra, 7619 Kennedy Road, Markham, Ontario, Canada, L3R 0L7

[21] Appl. No.: 833,909

[22] Filed: Apr. 10, 1997

[51] Int. Cl.[6] ..... A63B 69/36

[52] U.S. Cl. ..... 473/220

[58] Field of Search ..... 473/220

[56] References Cited

U.S. PATENT DOCUMENTS

| | | | |
|---|---|---|---|
| 4,456,257 | 6/1984 | Perkins | 473/220 |
| 4,913,441 | 4/1990 | Freer | 473/220 |
| 4,971,328 | 11/1990 | Hernberg | 473/220 |
| 5,217,228 | 6/1993 | Aguilar | 473/220 |
| 5,368,042 | 11/1994 | O'Neal et al. | 473/212 X |
| 5,435,562 | 7/1995 | Stock et al. | 473/220 |

*Primary Examiner*—George J. Marlo

[57] ABSTRACT

A lighted practice golf club for assisting in teaching a golfer to maintain the correct plane or line of travel for a golf club throughout the club swing. The club includes a special golf club a handle light positioned in a first end and a headlight positioned in a second end of the shaft of the golf club. A tubular passage extends through the shaft between the first and second ends. The shaft is comprised of an electrically conductive material and is electrically connected to a power source located in the shaft. One of the electrical terminals of the headlight is in electrical communication with the electrically conductive material of the shaft, and an electrical conducting wire extends through the tubular passage and is in electrical communication with the power source and the other of the electrical terminals of the headlight such that electrical power is supplied to the headlight by the electrical conducting wire and the shaft of the golf club.

6 Claims, 3 Drawing Sheets

LIGHTED PRACTICE GOLF CLUB

BACKGROUND OF THE INVENTION

1. Field of the Invention

The present invention relates to golf swing training aides and more particularly pertains to a new Lighted Practice Golf Club for offering a product that would teach a golfer to maintain the correct plane or line of travel throughout his swing.

2. Description of the Prior Art

The use of golf swing training aides is known in the prior art. More specifically, golf swing training aides heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf swing training aides include U.S. Pat. No. 4,913,441; U.S. Pat. No. 3,953,034; U.S. Pat. No. 4,693.479; U.S. Pat. No. Des. 339,396; U.S. Pat. No. 5,217, 228; and U.S. Pat. No. 5,388,831.

The Freer patent (U.S. Pat. No. 4,913,441) is for a club with a laser shining through the grip end only. This only assists the golfer for one half of his swing. As described later, the present invention proves superior because it assists the golfer throughout their entire swing motion. The Nelson patent (U.S. Pat. No. 3,953,034) teaches the golfer to return the club face square at impact and does not address swing plane. The McGwire patent (U.S. Pat. No. 4,693,479) is for an attachable laser unit that fastens to the grip end of the club only, making it similar to the Freer patent.

While these devices fulfill their respective, particular objectives and requirements, the aforementioned patents do not disclose a new Lighted Practice Golf Club. The inventive device is a conventional five-iron golf club, standard in length, lie, weight, and swing weight, and includes two miniature, battery powered lasers in the shaft. The club head and shaft are be made of steel, and the handle grip is made of rubber. One laser shines from the top of the gripping handle, the other from near the club head—shining from opposite ends of the club running along the same longitudinal axis as the shaft. The lasers are different in color so that the golfer will not confuse them when swinging quickly. Additionally, the lasers are also intense enough to be easily visible at high speeds and perhaps to be caught on video camera. The lasers are preferably, independently operated by a switch located just below the gripping handle. The golfer can use either light separately or both lights together. Only one light is needed when working on a particular segment of a golf swing, therefore saving battery life. Batteries are located under the gripping handle and can be accessed by unthreading a cap at the top of the grip. Furthermore, the club is suitably designed for actually hitting golf balls. Full instruction is included through video cassette and literature with tips and practice drills used to develop proper muscle memory.

In these respects, the Lighted Practice Golf Club according to the present invention substantially departs from the conventional concepts and designs of the prior art, and in so doing provides an apparatus primarily developed for the purpose of offering a product that would teach a golfer to maintain the correct plane or line of travel throughout his swing.

SUMMARY OF THE INVENTION

In view of the foregoing disadvantages inherent in the known types of golf swing training aides now present in the prior art, the present invention provides a new Lighted Practice Golf Club construction wherein the same can be utilized for offering a product that would teach a golfer to maintain the correct plane or line of travel throughout his swing.

The general purpose of the present invention, which will be described subsequently in greater detail, is to provide a new Lighted Practice Golf Club apparatus and method which has many of the advantages of the golf swing training aides mentioned heretofore and many novel features that result in a new Lighted Practice Golf Club which is not anticipated, rendered obvious, suggested, or even implied by any of the prior art golf swing training aides, either alone or in any combination thereof.

To attain this, the present invention generally comprises a special golf club having two miniature lasers or lights mounted in a shaft of the special golf club. The device teaches golfers to greatly improve their ball striking ability by visually demonstrating the correct path for their club throughout the entire motion. The device eliminates the confusion and misconceptions about swing plane by visually demonstrating when the user is on the ideal plane with the lasers on the target line. When the lasers are outside the line, the golfer's swing plane is too flat, and when they arc inside the line, the plane is too steep. The importance of swing plane is summarized as "the better a golfer's plane—the better the golfer".

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Lighted Practice Golf Club apparatus and method which has many of the advantages of the golf swing training aides mentioned heretofore and many novel features that result in a new Lighted Practice Golf Club which is not anticipated, rendered obvious, suggested, or even implied by any of the prior art golf swing training aides, either alone or in any combination thereof.

It is another object of the present invention to provide a new Lighted Practice Golf Club which may be easily and efficiently manufactured and marketed.

It is a further object of the present invention to provide a new Lighted Practice Golf Club which is of a durable and reliable construction.

An even further object of the present invention is to provide a new Lighted Practice Golf Club which is susceptible of a low cost of manufacture with regard to both materials and labor, and which accordingly is then susceptible of low prices of sale to the consuming public, thereby making such Lighted Practice Golf Club economically available to the buying public.

Still yet another object of the present invention is to provide a new Lighted Practice Golf Club which provides in the apparatuses and methods of the prior art some of the advantages thereof, while simultaneously overcoming some of the disadvantages normally associated therewith.

Still another object of the present invention is to provide a new Lighted Practice Golf Club for offering a product that would teach a golfer to maintain the correct plane or line of travel throughout his swing.

Yet another object of the present invention is to provide a new Lighted Practice Golf Club which includes a special golf club having two miniature lasers or lights mounted in a shaft of the special golf club.

Still yet another object of the present invention is to provide a new Lighted Practice Golf Club that would have the same dimensions as a standard five iron.

Even still another object of the present invention is to provide a new Lighted Practice Golf Club that could be offered in men's, women's, left-handed, and youth models.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
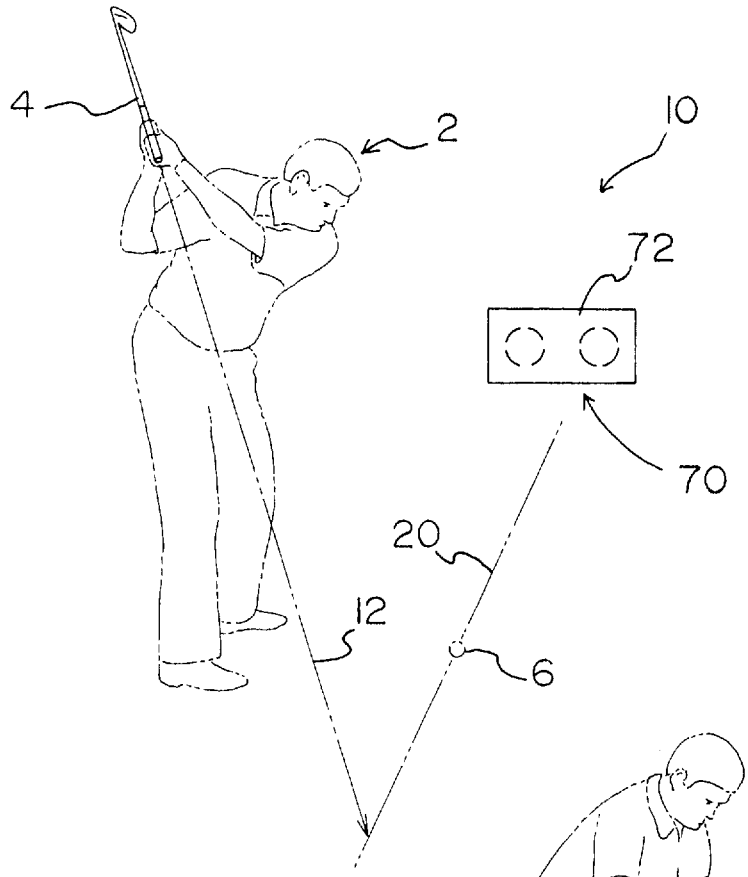
FIG. 1 is a front perspective view of a new Lighted Practice Golf Club in back swing use according to the present invention.

With reference now to the drawings, and in particular to FIGS. 1 through 6 thereof, a new Lighted Practice Golf Club embodying the principles and concepts of the present invention and generally designated by the reference numeral 10 will be described.

More specifically, it will be noted that the Lighted Practice Golf Club 10 comprises a golf club 4, a switch 30, a handle light 40, a power source 50, a headlight 60, and instructional means 70. The switch 30 is integrally, and electrically connected within a handle to handle light 40 and to the power source 50, and to the headlight 60, and instructional means 70 is a detached element for instruction which relates to the use of and the movement of the golf club 4.

Figure 2:
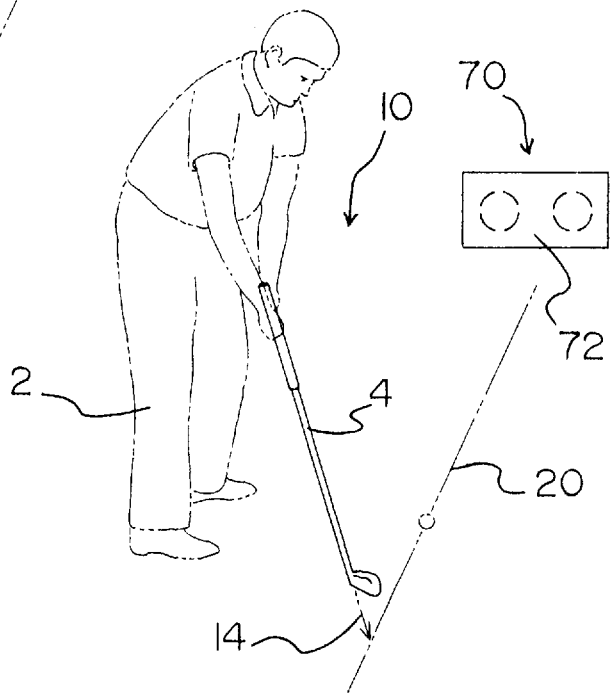
FIG. 2 is a front perspective view of a new Lighted Practice Golf Club in swing use according to the present invention.
Figure 3:
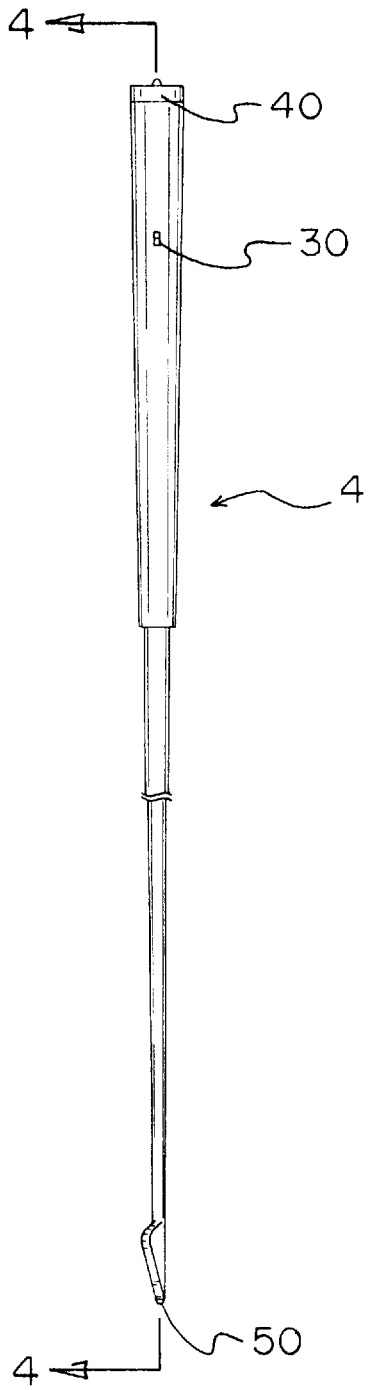
FIG. 3 is a side elevation view of the present invention.
Figure 4:
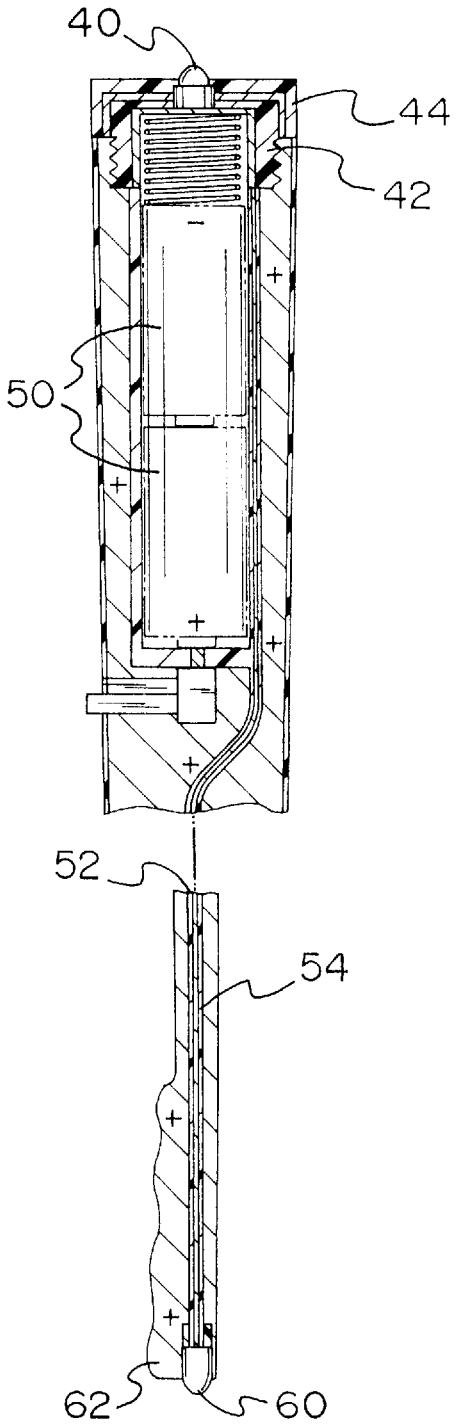
FIG. 4 is an enlarged cross sectional view taken along line 4—4 of FIG. 3.
Figure 5:
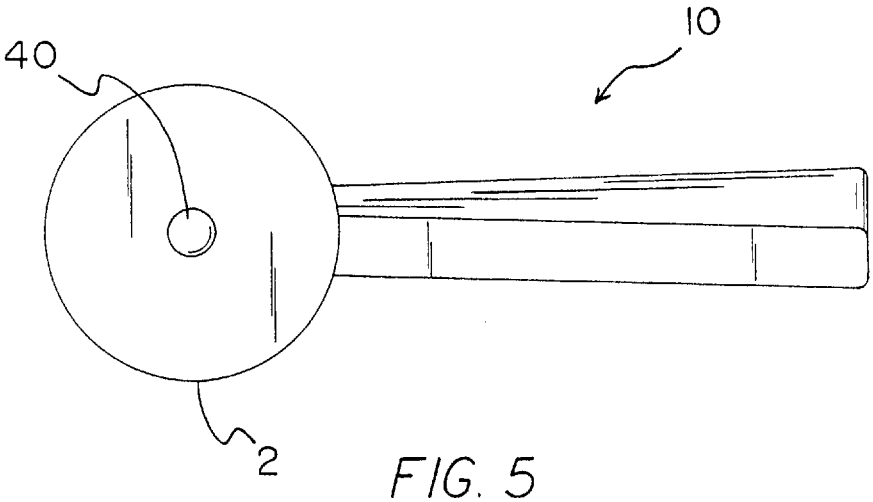
FIG. 5 is a top plan view of the present invention.
Figure 6:
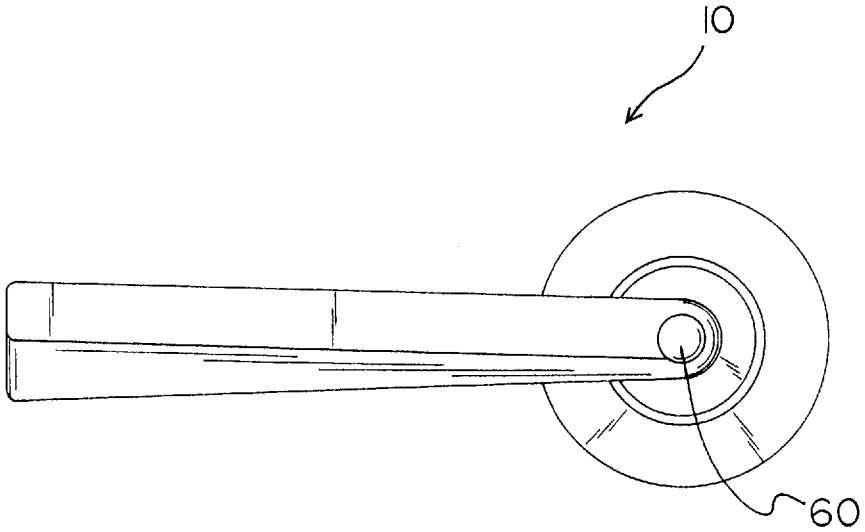
FIG. 6 is a bottom view of the present invention.

Referring to the FIGS. 1 through 6 and in particular to FIGS. 1 and 2, the golf club 4 is pulled back by a golfer 2 and the golf club 4 shines a first light beam 12 on a line of action 20, wherein the line of action 20 is a straight line going through a centroid or a tangent of a golf ball 6, and where the switch 30 is activated to energize electrical connection from the power source 50 to the handle light 40 and to a headlight 60, and where the instructional means 70 is used to provide instruction when first light beam 12 goes astray or off of the line of action 20, instructional means 70 provides instruction as to how to make a corrective change to get first light beam 12 back on to and following the line of action 20.

As best illustrated in FIG. 2, it can be shown that the golfer 2 has swung the club 4 around into position where he is going to swing over the top of the golf ball 6 and a second light beam 14 shines out of a head end of the golf club 4 and will follow along on the line of action 20 and whenever second light beam 14 deviates from the line of action 20, the instructional means 70 provides instruction as to how to correctly achieve corrective action to cause the second light beam 14 to follow along the line of action 20.

Handle light 40 and power source 50 are fixedly retained within a handle end of golf club 4 by a power source retainer 42, which in turn is held in place by handle light retainer 44. In a preferred embodiment, the power source retainer 42 is threadedly attached to the handle of the golf club 4 and the handle light retainer 44 is fixedly depressed and retained by interference fit with an inner diameter of the handle end of the golf club 40, and wherein the handle light 40 shines through an inline concentrically located aperture in both the power source retainer 42 and the handle light retainer 44.

Power source 50 is electrically connected to a wire tube 52 and a power transfer means 54 wherein the power source is further defined as direct current voltage batteries and wire tube 52 is preferably made of a metallic material for conduction of electrical current and power transfer means 54 is further defined as a pair of wires which extend and run down through the handle of the golf club 4 and through a barrel shaft of golf club 4 and wherein the power transfer means 54 extendedly runs throughout a length of the barrel shaft of the golf club 4 all the way to the head of the golf club 4 and electrically connects to the head light 60 of the golf club 4. The headlight 60 is fixedly held in place and attached to the golf club 4 by a headlight retainer 62 which is further defined as an aperture within the head of the golf club 4. The instructional means 70 is further defined as a VCR tape 72 which is prerecorded to show a variety of messages and instructions as to how to swing and use the lighted practice golf club 10 along with corrective measures that can be taken to correct golf swing.

The general construction of the golf club 4 is similar and like that of other conventional golf clubs in that the handle and grip are all the same, however the difference is that the golf club 4 is made of steel instead of the conventional materials and weighted to be equal and equivalent to that of a five iron golf club.

Beginning with a golfer in his address position, with the club having both lights on, and the ball and the target line identified, for a model swing plane, the end of the club that is closest to the ground should point directly at the target line at all times. As the golfer takes the club back, the head light (14) will trace the target line behind the ball. The club comes to a position where it is parallel to the target line, and neither light will point at the line. As the golfer continues his back swing, the light from the grip end (12) starts to trace the target line from ahead of the golf ball. As the golfer continues back, the light 12 will continue to trace the line over the top of the ball, then extending behind the ball, to a position like FIG. 1. The golfer completes his back swing and begins his forward swing in a reverse manner—light 12 traces the line from behind the ball, to over top of the ball, to ahead of the ball. Again the club will come to a position where it is parallel to the line, so no light points at it. Then the club head will start to drop, and light 14 will trace the line from behind the ball (like FIG. 2), through impact with the ball, and extend well down the target line to a point where it is again parallel with the line. The club head will come up again and light 12 will now point at the line from well behind where the ball used to be. The follow through will carry light 12 all the way down along the target line to well ahead of the divot, into the completion of the swing. The theory is that the practice swing simply traces the target line with the lowest light throughout the entire golf swing to indicate a pure, on plane swing.

More particularly, in use, the golfer 2 takes a golf club 4, winds back and shines first light beam 12 toward the ground along a line of action 20, which can be preprinted, or attained by means of a tape or other straight line marking methods on a ground surface. The golfer 2 proceeds to swing golf club 4 and watch and trace the first light beam as it travels along the line of action 20. Whenever the first light beam deviates from the line of action 20, the golfer refers to instructional means 70 for corrective measures as to how to compensate and get back onto the line of action 20. When the golfer 2 has swung the golf club down so that the head is pointed downward at an angle anywhere from 70 degrees to 30 degrees from vertical and preferably at an angle of 45 degrees, the golfer 2 then resorts to a second light beam 14 and now changes his eyes to watch the second light beam 14 as it follows along the line of action 20. Again, if the golfer deviates with the second light beam 14 from the line of action 20, he refers to instructional means 70 for compensation measures with which to teach himself. The final result is that the golfer 2 works at teaching himself an effective means of swinging and going through the golf stroke motion and by habit and practice causes himself to be able to swing quickly and accurately striking a golf ball to make the golf ball go where the golfer 2 wishes it to go.

Additionally, another option for the present invention could include a video camera scope lens fixedly attached adjacently to the handle light 40 and to the head light 60 which would be electrically connected to the power source 50 and to a video recording apparatus as well. A furtherance of this option would include the inputting of the video taped during practice swings and the inputting of the instructional means 70 into a computer and the programming of the computer to interfacingly prompt the user like a coach would. Further still, the instructional means 70 could be computer software which is already preprogrammed to interface with state of the art computer technology and where the video camera scope lens would be electrically connected to the computer as well and therefore when the user practices in conjunction with the computer, immediate and expedient advice is disseminated and given back to the user quickly, thereby making the computer and a personal coach, synonymous.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lighted practice golf club for use with a golf ball positioned on a line of action on a ground surface, said line of action passing through said golf ball and extending in the desired golf stroke direction, said practice golf club comprising:

a golf club having an elongate shaft with a longitudinal axis, said shaft having first and second ends, said first end having a handle for gripping by a user and said second end having a club head mounted thereon for striking a golf ball, said shaft having a central receptacle with an opening at said first end, a replaceable power source located in said central receptacle, a handle light positioned in said first end of said golf club adjacent said handle and adapted to project a first light beam from said first end along an extension of the longitudinal axis of said golf club for providing a visual indication of the swing path of the golf club during the initial portion of the user's swing, and a headlight positioned in said second end of said golf club adjacent said club head and adapted to project a second light beam from said second end along an extension of the longitudinal axis of said golf club for providing a visual indication of the swing path of the golf club during the later portion of the user's swing, said headlight having two electrical terminals for providing electrical power thereto, wherein a tubular passage extends through the shaft of said golf club between said first and second ends, said shaft being comprised of an electrically conductive material and being electrically connected to said power source, one of said electrical terminals of said headlight being in electrical communication with the electrically conductive material of said shaft, a electrical conducting wire extending through said tubular passage and being in electrical communication with said power source and the other of said electrical terminals of said headlight such that electrical power is supplied to said headlight by said electrical conducting wire and the shaft of said golf club.

2. The lighted practice golf club of claim 1 additionally comprising a switch mounted on the shaft of said golf club, wherein said switch may be activated to selectively complete the electrical connection from the power source to the handle light and to the headlight.

3. The lighted practice golf club of claim 1 wherein the handle light and the power source are fixedly retained within the handle end of golf club by a retaining cap threadedly mounted to the first end of said shaft, said retaining cap has an aperture therein for receiving said handle light such that the handle light shines through said aperture.

4. The lighted practice golf club of claim 1 wherein the power source is further defined as two direct current voltage batteries.

5. The lighted practice golf club of claim 1 wherein the golf club is made of steel and weighted to be equal to that of an iron golf club.

6. A lighted practice golf club for use with a golf ball positioned on a line of action on a ground surface, said line of action passing through said golf ball and extending in the desired golf stroke direction, said practice golf club comprising:

a golf club having an elongate shaft with a longitudinal axis, said shaft having first and second ends, said first end having a handle for gripping by a user and said second end having a club head mounted thereon for striking a golf ball, said shaft having a central receptacle with an opening at said first end, a replaceable power source located in said central receptacle, a handle light positioned in said first end of said golf club adjacent said handle and adapted to project a first light beam from said first end along an extension of the longitudinal axis of said golf club for providing a visual indication of the swing path of the golf club during the initial portion of the user's swing, and a headlight positioned in said second end of said golf club adjacent said club head and adapted to project a second light beam from said second end along an extension of the longitudinal axis of said golf club for providing a visual indication of the swing path of the golf club during the later portion of the user's swing, said headlight having two electrical terminals for providing electrical power thereto, wherein a tubular passage extends through the shaft of said golf club between said first and second ends, said shaft being comprised of an electrically conductive material and being electrically connected to said power source, one of said electrical terminals of said headlight being in electrical communication with the electrically conductive material of said shaft, a electrical conducting wire extending through said tubular passage and being in electrical communication with said power source and the other of said electrical terminals of said headlight such that electrical power is supplied to said headlight by said electrical conducting wire and the shaft of said golf club;

a switch mounted on the shaft of said golf club, wherein said switch may be activated to selectively complete the electrical connection from the power source to the handle light and to the headlight;

wherein the handle light and the power source are fixedly retained within the handle end of golf club by a retaining cap threadedly mounted to the first end of said shaft, said retaining cap has an aperture therein for receiving said handle light such that the handle light shines through said aperture;

wherein the power source is further defined as two direct current voltage batteries; and wherein the golf club is made of steel and weighted to be equal to that of an iron golf club.

* * * * *